US006479927B1

(12) United States Patent
Ju

(10) Patent No.: US 6,479,927 B1
(45) Date of Patent: Nov. 12, 2002

(54) ELECTRODE OF ELECTRON GUN AND ELECTRON GUN USING THE SAME

(75) Inventor: Hyoung-il Ju, Pusan (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 55 days.

(21) Appl. No.: 09/612,632

(22) Filed: Jul. 7, 2000

(30) Foreign Application Priority Data

Jul. 7, 1999 (KR) ..... 99-27241

(51) Int. Cl.[7] ..... H01J 29/56

(52) U.S. Cl. ..... 313/414; 313/412; 313/432; 313/460

(58) Field of Search ..... 313/412, 414, 313/409, 421, 426, 432, 413, 449, 460

(56) References Cited

U.S. PATENT DOCUMENTS 4,370,592 A 1/1983 Hughes et al.
4,626,783 A 12/1986 Ohuchi
5,414,323 A 5/1995 Uchida et al.
5,883,463 A * 3/1999 Kikuchi et al. ..... 313/414
5,932,958 A * 8/1999 Watanabe et al. ..... 313/414 X

* cited by examiner

*Primary Examiner*—Ashok Patel
(74) *Attorney, Agent, or Firm*—Lowe Hauptman Gilman & Berner, LLP

(57) ABSTRACT

An electrode of an electron gun, and an electron gun for a cathode ray tube are provided. The electron gun includes an outer-rim electrode having a large-diameter electron beam passing hole through which three electron beams pass, and an inner electrode installed inside the outer-rim electrode member, and having three electron beam passing holes disposed in an in-line arrangement and recesses formed at peripheries of the electron beam passing holes, the recesses having an eccentricity distance larger than an eccentricity distance between centers of the three electron beam passing holes.

23 Claims, 6 Drawing Sheets

ELECTRODE OF ELECTRON GUN AND ELECTRON GUN USING THE SAME

BACKGROUND OF THE INVENTION

1. Field of the Invention

The present invention relates to a cathode ray tube (CRT), and more particularly, to an electrode of an electron gun for forming a large-diameter electronic lens and an electron gun using the same.

2. Description of the Related Art

In general, spherical aberration and focusing characteristics in an electron gun for a CRT, are greatly affected by a main lens. Thus, in order to obtain good focusing characteristics, it is preferable to form a main lens having a diameter as large as possible.

However, in an in-line type electron gun, each three electron beam passing holes are formed in an in-line arrangement in at least two electrodes for forming an electron lens, and the diameter of a neck portion of a funnel in which the electron gun is mounted is limited. Thus, it is not possible to make the diameter of an electron beam passing hole larger than a distance between centers of two neighboring electron beam passing holes, which will be referred to as an "eccentricity distance" hereinafter.

Electrodes of an electron gun for improving spherical aberration in a conventional main lens are disclosed in U.S. Pat. No. 4,370,592, which is shown in FIG. 1.

As shown in the drawing, burring portions 1*b* and 2*b* are formed at edges of an emitting surface 1*a* of a focusing electrode 1 and an entering surface 2*a* of a final accelerating electrode 2, and large-diameter electron beam passing holes 1H and 2H having a predetermined depth, are formed in the central portion thereof, respectively. Also, small-diameter electron beam passing holes 1H' and 2H' through which R, G and B electron beams pass independently are formed in the large-diameter electron beam passing holes 1H and 2H.

When electron beams pass through a main lens formed by the focusing electrode 1 and the final accelerating electrode 2, since the large-diameter electron beam passing holes 1H and 2H are horizontally elongated, the vertically and horizontally focused components of the electron beams having passed through the central small diameter electron beam passing hole and the side small-diameter electron beam passing holes are different. Thus, it is not possible to obtain uniformity in the spot size of electron beams landing on a phosphor screen. In other words, as shown in FIG. 2, the side electron beams RB and BB having passed through the large-diameter electron beam passing hole 1H or 2H of the focusing electrode 1 or the final accelerating electrode 2 are close to the burring portions 1*b* and 2*b*, and the central electron beams GB is relatively far from the burring portions 1*b* and 2*b*. Therefore, the side electron beams RB and BB are relatively strongly focused and the central electron beam GB is relatively weakly focused.

Also, since the distances between the side electron beams RB and BB and the burring portions 1*b* and 2*b* are different according to direction, that is, horizontally or vertically, horizontal and vertical focusing powers of the side electron beams RB and BB are different. Also, since the vertical distances between the central electron beam GB and the burring portions 1*b* and 2*b* are shorter than the horizontal distances therebetween, the central electron beam GB is strongly focused in a vertical direction. Also, the central electron beam GB is diverged in a diagonal direction of the large-diameter electron beam passing hole 1H or 2H. Therefore, the side electron beams RB and BB having passed through the main lens have substantially triangular cross-sections and the central electron beam GB has a cross-section having radially projecting parts, so that a uniform shape in electron beam cross-sections cannot be obtained throughout the entire phosphor screen.

In particular, since the sizes of the small-diameter electron beam passing holes 1H' and 2H' are restricted by the diameter of the neck portion of a CRT, there is a limit in increasing the eccentricity distance between the small-diameter electron beam passing holes 1H' and 2H'. Further, in recent years, there has been a tendency to reduce the diameter of the neck portion for reducing a deflection current, the distance between the small-diameter electron beam passing holes 1H' and 2H' is reduced accordingly, thereby degrading spherical aberration and focusing characteristics.

An electrode structure of an electron gun for solving the above-mentioned problem is disclosed in U.S. Pat. No. 5,414,323. As shown in FIG. 3, the electrode structure is constructed such that an electrode member 12 is disposed at the center of an outer electrode 11 having a large-diameter electron beam passing hole, a vertically elongated small-diameter electron beam passing hole 13 is formed in the center of the electrode member 12 and both edges of the electrode member 12 are recessed in a half-elliptical shape to form side electron beam passing holes 14 and 15.

The central small-diameter electron beam passing hole 13 is vertically elongated to offset astigmatism generated by the large-diameter electron beam passing hole. However, this electrode structure cannot easily correct 8-pole coma aberration of a central electron beam passing hole and 6-pole coma aberration of side electron beam passing holes.

An example of another conventional large-diameter electrode is disclosed in U.S. Pat. No. 4,626,783. This electrode, as shown in FIG. 4, includes an outer electrode 21 having a large-diameter electron beam passing hole, and an inner electrode 22 installed within the outer electrode 21 and having polygonal small-diameter electron beam passing holes 22R, 22G and 22B. Here, the aberration generated by the large-diameter electron beam passing hole can be corrected by the polygonal small-diameter electron beam passing holes 22R, 22G and 22B. However, it is not easy to fabricate polygonal small-diameter electron beam passing holes.

SUMMARY OF THE INVENTION

To solve the above problems, it is an object of the present invention to provide an electrode of an electron gun for a color cathode ray tube, which can easily correct aberration of an electronic lens caused by a large-diameter electron beam passing hole and can improve focusing characteristics.

It is another object of the present invention to provide an electron gun for a color cathode ray tube, which can reduce astigmatism by compensating for distortion of an electron beam due to a difference in the voltage applied to three electron beam passing holes disposed in an in-line arrangement.

To accomplish the first object of the present invention, there is provided an electrode of an electron gun for a color cathode ray tube including an outer-rim electrode having a large-diameter electron beam passing hole through which three electron beams pass, and an inner electrode installed inside the outer-rim electrode member, and having three electron beam passing holes disposed in an in-line arrangement and recesses formed at peripheries of the electron beam passing holes, the recesses having an eccentricity distance larger than an eccentricity distance between centers of the three electron beam passing holes.

In the present invention, the horizontal width of each of the recesses formed at peripheries of the electron beam passing holes is preferably smaller than the vertical width thereof.

According to another aspect of the present invention, there is provided an electron gun for a cathode ray tube, the electron gun having a cathode, a control electrode and a screen electrode together constituting a triode section, and focusing electrodes installed to be adjacent to the screen electrode and forming at least one electronic lens, wherein each of the focusing electrodes includes an outer-rim electrode having a large-diameter electron beam passing hole through which three electron beams pass, and an inner electrode installed inside the outer-rim electrode member, and having three electron beam passing holes disposed in an in-line arrangement and recesses formed at peripheries of the electron beam passing holes, the recesses having an eccentricity distance larger than an eccentricity distance between centers of the three electron beam passing holes.

Preferably, the horizontal widths of the large-diameter electron beam passing holes formed in the outer-rim electrodes are different.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

An electron gun for a cathode ray tube (CRT) using an electrode according to an embodiment of the present invention includes a cathode, a control electrode and a screen electrode together constituting a triode section, and at least a pair of first and second focusing electrodes for forming auxiliary and/or main lenses. A predetermined voltage is applied to each cathode and the respective electrodes. For example, a voltage of 0 to 200 V is applied to the control electrode, a voltage of 200 to 700 V is applied to the screen electrode, and 28 to 30% of the voltage applied to the second focusing electrode situated at a screen side is applied to the first focusing electrode situated at the cathode side. Here, a dynamic focusing voltage synchronized with a deflection signal may be applied to the first focusing electrode situated to the cathode side.

Figure 6:
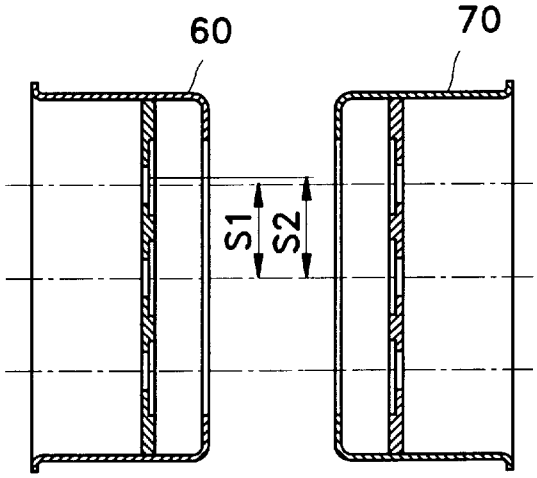
FIG. 6 is a cross-sectional view of the electrode shown in FIG. 5.
Figure 12:
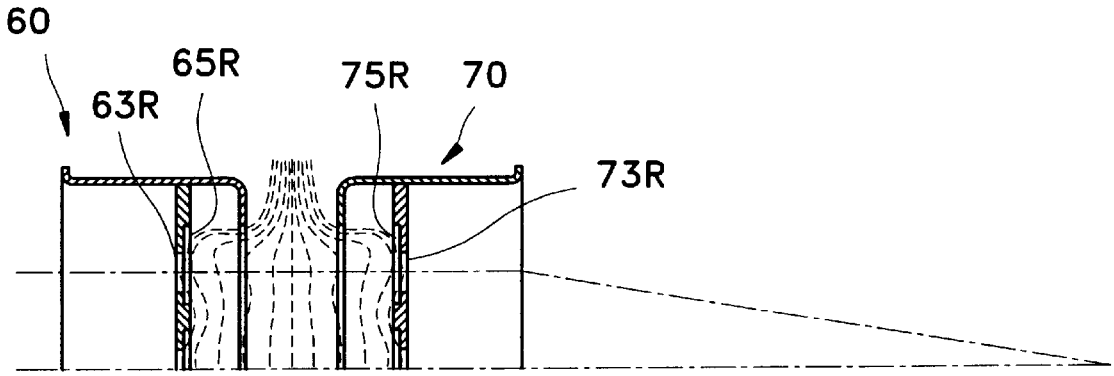
FIG. 12 is a cross-sectional view illustrating the convergence state of electrode beams.

As shown in FIGS. 6 and 12, first and second focusing electrodes 60 and 70 include outer-rim electrodes 62 and 72 having large-diameter electron beam passing holes 61 and 71 through which three electron beams pass, and include inner electrodes 63 and 73 installed inside the outer-rim electrodes 62 and 72 and having each and separate small-diameter electron beam passing holes 63R, 63G and 63B, and 73R, 73G and 73B.

The convergence characteristics of three electron beams can be adjusted such that the horizontal widths of the large-diameter electron beam passing holes 61 and 71 formed in the outer-rim electrodes 62 and 72 are made different.

Each three recesses 65R, 65G and 65B and 75R, 75G and 75B having an eccentricity distance S2 which is relatively larger than an eccentricity distance S1 between centers of the three electron beam passing holes, are formed at the peripheries of the three separate small-diameter electron beam passing holes 63R, 63G and 63B, and 73R, 73G and 73B formed in the inner electrodes 63 and 73, respectively.

Figure 1:
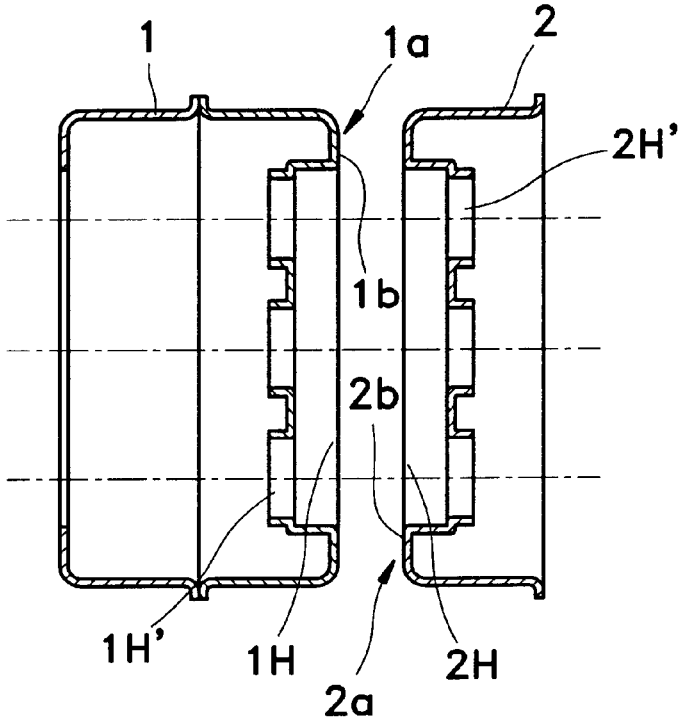
FIG. 1 (PRIOR ART)
FIG. 1 is a cross-sectional view illustrating a conventional electrode of an electron gun for a color cathode ray tube.
Figure 2:
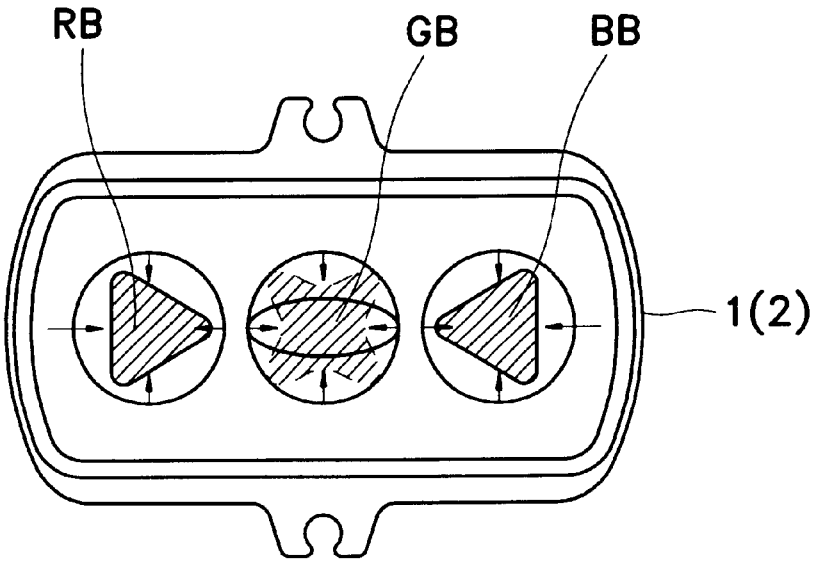
FIG. 2 (PRIOR ART)
FIG. 2 is a front view illustrating the electrode shown in FIG. 1, in which cross-sections of electron beams are shown.
Figure 3:
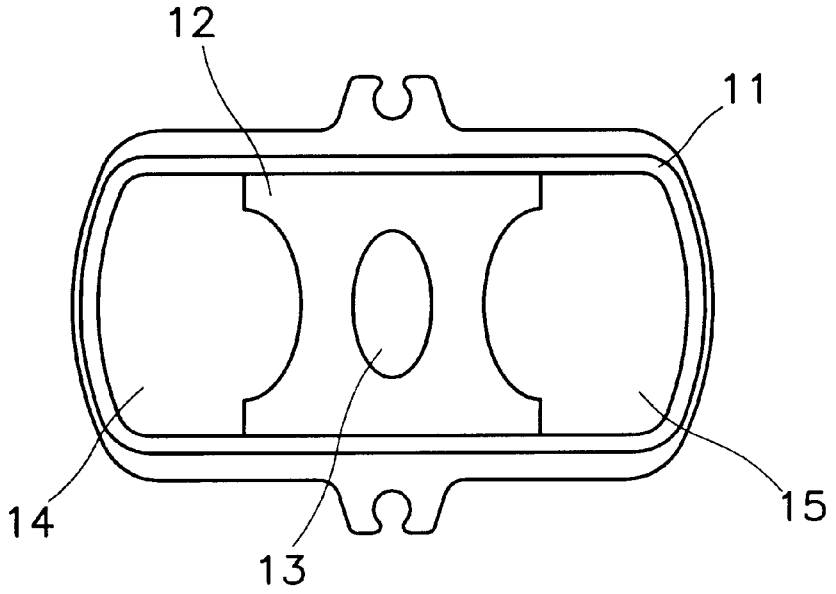
FIG. 3 (PRIOR ART)
FIGS. 3 and 4 are front views illustrating examples of another conventional electrodes.
Figure 4:
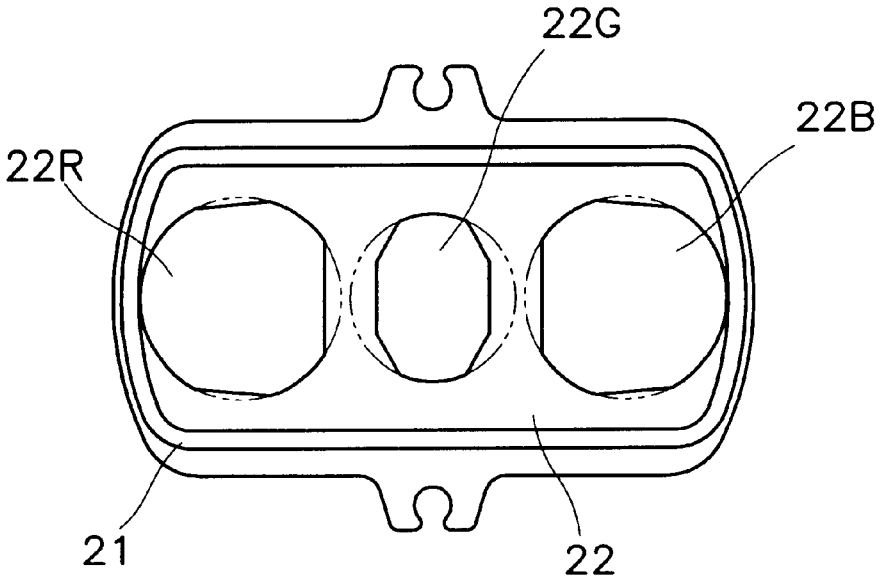
FIG. 4 (PRIOR ART)
Figure 5:
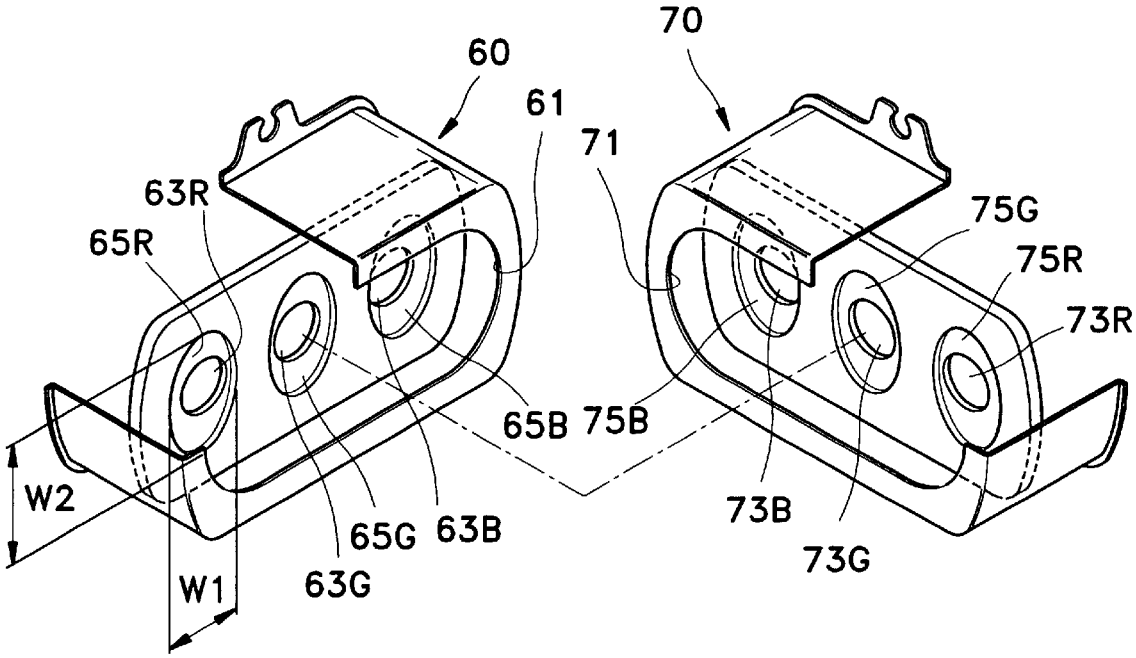
FIG. 5 is a partially exploded perspective view illustrating an electrode of an electron gun according to the present invention.
Figure 7:
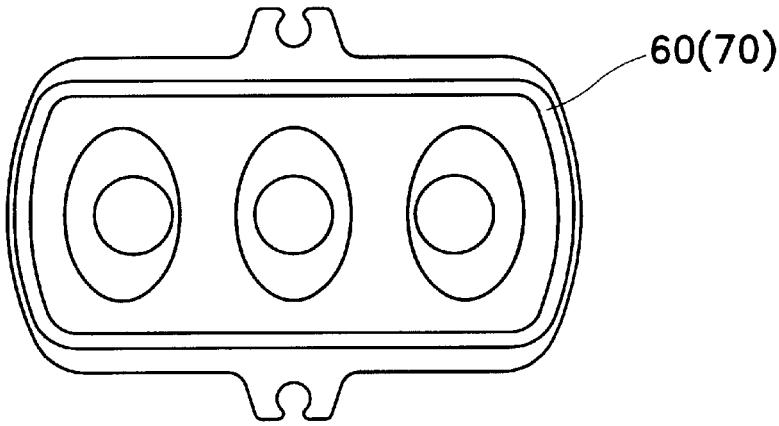
FIG. 7 is a front view of the electrode shown in FIG. 5.

As shown in FIGS. 5 and 7, the recesses 65R, 65G and 65B and 75R, 75G and 75B formed in the respective inner electrodes 63 and 73 are formed such that each horizontal width W1 is smaller than each vertical width W2.

Figure 8:
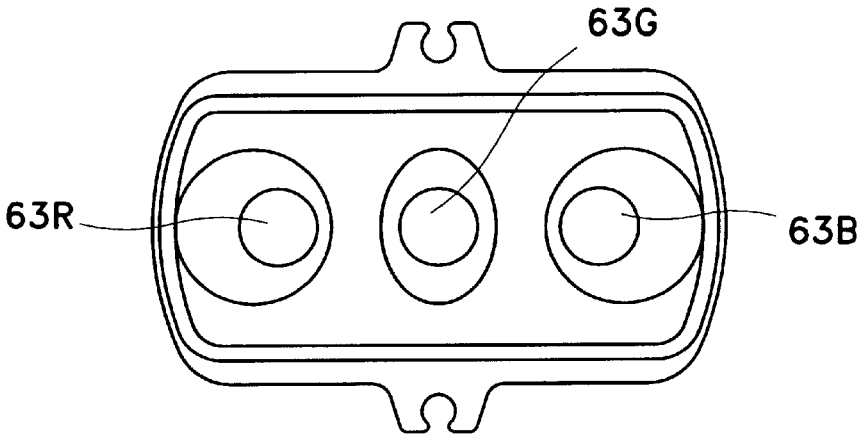
FIGS. 8 and 9 are front views of another examples of the electrode according to the present invention.

In another example, as shown in FIG. 8, a recess formed in the periphery of the central electron beam passing hole 63G is vertically elongated and recesses formed in the peripheries of the side electron beam passing holes 63R and 63B are circular.

Figure 9:
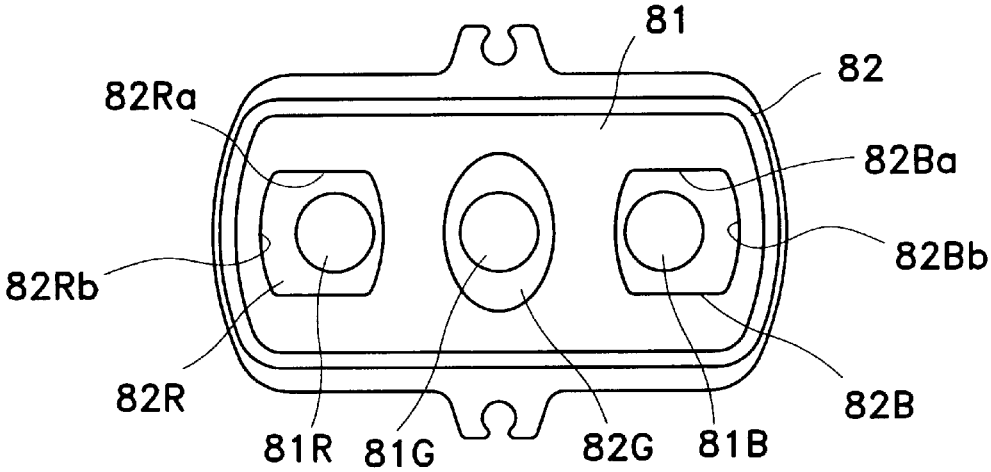

FIG. 9 shows another example of the recess according to the present invention.

As shown in the drawing, among three separate electron beam passing holes 81R, 81G and 81B formed in an inner electrode 81 in an in-line arrangement, a recess 82G formed in the periphery of the central electron beam passing hole 81G is vertically elongated, and recesses 82R and 82B formed in the peripheries of side electron beam passing holes 81R and 81B have plane portions 82R*a* and 82B*a* at upper and lower parts of the electron beam passing holes 81R and 81B, and have curved portions 82R*b* and 82B*b* at both sides thereof. Here, the maximum vertical width of each recess is the same as the maximum horizontal width thereof.

Figure 10:
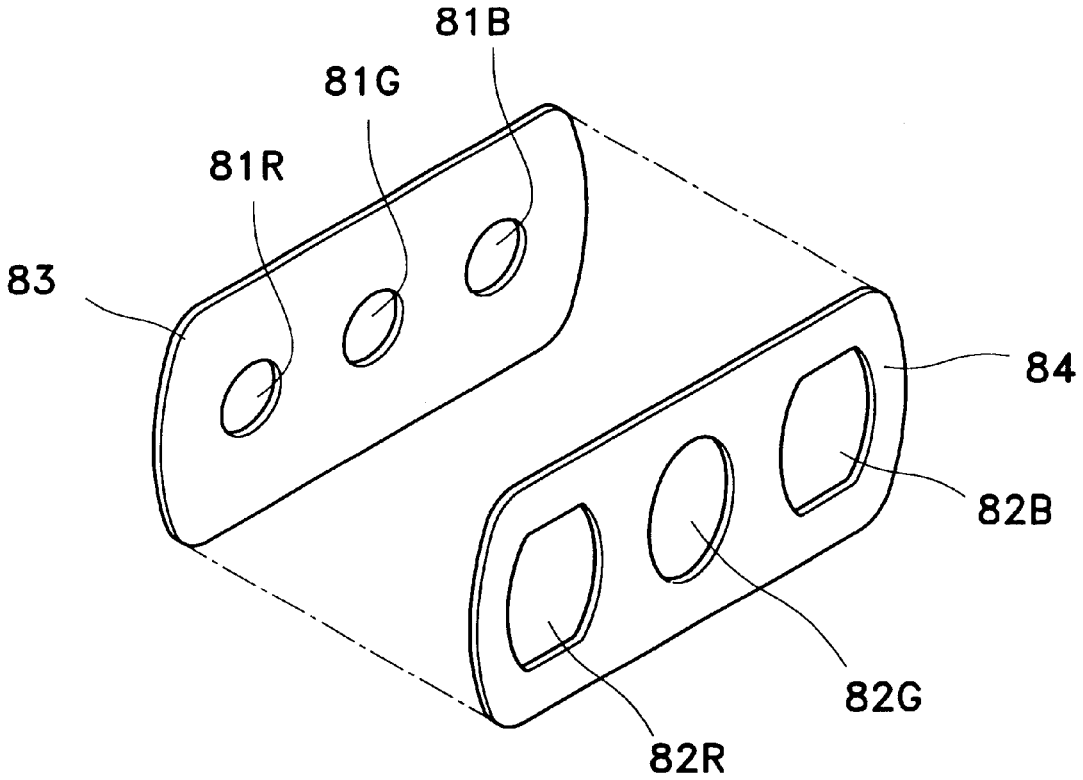
FIG. 10 is an exploded perspective view illustrating another example of an inner electrode.
Figure 11:
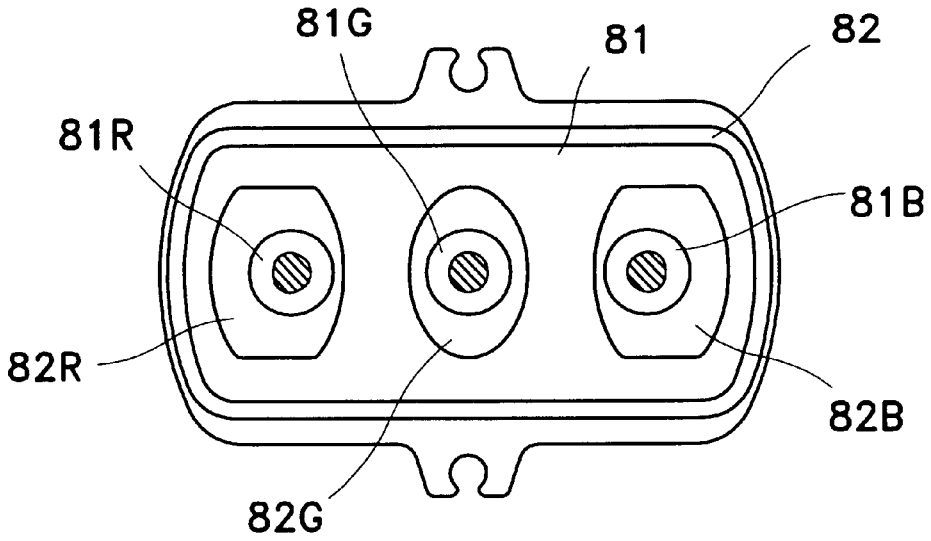
FIG. 11 is a diagram illustrating cross-sections of electron beams passing through electron beam passing holes of the electrode according to the present invention.

Alternatively, as shown in FIG. 10, recesses of an inner electrode may be configured by a combination of a first electrode member 83 having three separate small-diameter electron beam passing holes 81R, 81G and 81B disposed in an in-line arrangement, and a second electrode member 84 having three throughholes 82R, 82G and 82B having recesses that have the same shapes as the recesses shown in FIG. 9.

The shapes of the recesses of the respective inner electrodes are not limited to those of the above-described examples and may differ according to aberration of a large-diameter lens formed by a large-diameter electron beam passing hole as a predetermined voltage is applied. Any structure can be used that is capable of correcting a difference in the converging/diverging powers due to a horizontal electric field of the large-diameter electron beam passing hole.

The operation of the aforementioned electrode of an electron gun and an electron gun for a color CRT using the electrode will now be described in detail.

Predetermined voltages are applied to a cathode and various electrodes constituting the electron gun. If the voltages are applied in the above-described manner, a pre-focusing lens is formed between a control electrode and a screen electrode, and a main lens is formed between first and second focusing electrodes.

The main lens formed between the first and second focusing electrodes forms an electronic lens such that an equipotential surface is established in a normal direction of an electric field formed between the first and second focusing electrodes 60 and 70, and electron beams pass through the electronic lens.

Here, as described above, since the large-diameter electron beam passing holes 61 and 71 are horizontally elongated, the vertically and horizontally focused components of the electron beams having passed through the central small diameter electron beam passing holes 63G and 73G and side small large-diameter electron beam passing holes 63R, 63B, 73R and 73B are different. Thus, the electron beams experience different focusing and diverging powers. This action causes a difference in the focus voltage between three electron beams, thereby degrading focusing characteristics of the electron beams.

Since the recesses 65G and 75G formed at peripheries of the central electron beam passing holes 63G and 73G are vertically elongated, that is, the vertical widths of the recesses 65G and 75G are greater than the horizontal widths thereof, the vertical diverging power of the electron beam passing through the central electron beam passing hole 63G is made large, thereby compensating for a difference in the vertical and horizontal converging/diverging powers of a large-diameter lens.

Also, the recesses 65R, 65B, 75R and 75B formed at peripheries of the side electron beam passing holes 63R, 63B, 73R and 73B have an eccentricity distance larger than an eccentricity distance between centers of electron beam passing holes and are vertically elongated or have plane portions at upper and lower parts thereof and curved portions at both sides. Thus, it is possible to achieve effects of suppressing distortion due to a difference in the horizontal and vertical converging/diverging powers of the large-diameter electron beam passing hole and increasing the electron beam passing hole. In particular, since the eccentricity distance between the recesses is larger than the eccentricity distance between three separate small-diameter electron beam passing holes, the electronic lenses formed by side small-diameter electron beam passing holes are made asymmetric, thereby improving convergence, as shown in FIG. 12.

Also, the cross-sections of electron beams passing through side separate small-diameter electron beam passing holes can be corrected by the recesses of the inner electrodes to be substantially circular. Thus, the cross-sections of the electron beams passing through the electronic lens are substantially circular, thereby obtaining uniformity in the shapes of the cross-sections of electron beams through an overall phosphor screen (not shown).

In the electrode for an electron gun according to the present invention, aberration of electron beams caused by a large-diameter electron beam passing hole can be reduced and the cross-sections of the electron beams can be changed into a desired shape. In particular, the focusing characteristics of electron beams can be improved by reducing the difference in the focusing voltage of the electron beams passing through the large-diameter electron beam passing hole.

While the present invention has been described in conjunction with the preferred embodiment disclosed, it will be apparent to those skilled in the art that various modifications and variations can be made within the spirit or scope of the invention. For example, the present invention can be applied to a plate-shaped electrode or a rim electrode of a screen electrode or a focusing electrode.

What is claimed is:

1. An electrode of an electron gun for a color cathode ray tube, said electrode comprising:

an outer-rim electrode having a large electron beam passing hole through which three electron beams pass; and an inner electrode installed inside the outer-rim electrode member, and having three electron beam passing holes disposed in an in-line arrangement and recesses formed at peripheries of the electron beam passing holes, the recesses having an eccentricity distance larger than an eccentricity distance of the electron beam passing holes.

2. The electrode according to claim 1, wherein the horizontal width of each of the recesses formed at peripheries of the electron beam passing holes is smaller than the vertical width thereof.

3. The electrode according to claim 1, wherein each of the recesses formed at peripheries of the respective electron beam passing holes is circular.

4. The electrode according to claim 1, wherein each of the recesses formed at peripheries of the respective electron beam passing holes has plane portions at upper and lower edges thereof and curved portions at both sides thereof.

5. The electrode according to claim 4, wherein the vertical widths of the recesses formed at both side electron beam passing holes are the same as the horizontal widths thereof.

6. An electron gun for a cathode ray tube, the electron gun a cathode, a control electrode and a screen electrode together constituting a triode section; and focusing electrodes installed adjacent to the screen electrode and forming at least one electronic lens;

wherein each of the focusing electrodes comprises:

an outer-rim electrode having a large electron beam passing hole through which three electron beams pass; and an inner electrode installed inside the outer-rim electrode member, and having three electron beam passing holes disposed in an in-line arrangement and recesses formed at peripheries of the electron beam passing holes, the recesses having an eccentricity distance larger than an eccentricity distance of the electron beam passing holes.

7. The electron gun according to claim 6, wherein the horizontal width of each of the recesses formed at peripheries of the electron beam passing holes is smaller than the vertical width thereof.

8. The electron gun according to claim 6, wherein each of the recesses formed at peripheries of the respective electron beam passing holes is circular.

9. The electron gun according to claim 6, wherein each of the recesses formed at peripheries of the respective electron beam passing holes has plane portions at upper and lower edges thereof and curved portions at both sides thereof.

10. The electron gun according to claim 9, wherein the vertical widths of the recesses formed at both side electron beam passing holes are the same as the horizontal widths thereof.

11. The electron gun according to claim 6, wherein the horizontal widths of the large electron beam passing holes formed in the outer-rim electrodes are different.

12. An electrode of an electron gun for a color cathode ray tube, said electrode comprising:

a larger electron beam passing hole through which three electron beams pass; and three smaller electron beam passing holes disposed in an in-line arrangement and in alignment with the larger-diameter electron beam passing hole to allow each of the electron beams to pass through one of said smaller electron beam passing holes; wherein each of said smaller electron beam passing holes has, as seen along a propagation path of the respective electron beam, a first section aperture telescopically arranged inside a second section aperture; and a distance between centers of the first section apertures of adjacent said smaller electron beam passing holes is smaller than a distance between centers of the respective second section apertures.

13. The electrode according to claim 12, wherein the second section apertures are vertically elongated.

14. The electrode according to claim 12, wherein the first section apertures are circular.

15. The electrode according to claim 14, wherein the second section apertures are elliptic.

16. The electrode according to claim 14, wherein the second section aperture of the central hole among said smaller electron beam passing holes is elliptic while the second section apertures of the other of said smaller electron beam passing holes are circular.

17. The electrode according to claim 12, wherein each of the second section apertures of the lateral holes among said smaller electron beam passing holes has two straight sides connecting two outwardly curved sides.

18. The electrode according to claim 17, wherein a distance between the straight sides is substantially equal to a maximum distance between the curved sides.

19. The electrode according to claim 18, wherein the distance between the straight sides is smaller than a maximum dimension of the second section aperture of the central hole among said smaller electron beam passing holes which is elliptic.

20. The electrode according to claim 17, wherein the second section apertures are vertically elongated.

21. The electrode according to claim 12, wherein said electrode comprises an outer tubular electrode member and an inner plate electrode member disposed inside the outer tubular electrode member, the larger electron beam passing hole is formed at an end portion of the outer tubular electrode member, the smaller electron beam passing holes are formed to extend through the inner plate electrode member.

22. The electrode according to claim 21, wherein the first and second section apertures of each of the smaller electron beam passing holes extend inwardly from opposite faces of the inner plate electrode member so that said smaller electron beam passing hole has a stepped cross section.

23. The electrode according to claim 21, wherein the inner plate electrode member comprises two separate plate members through which the first and second section apertures are formed, respectively.

* * * * *